US007931385B1

(12) United States Patent
Smith

(10) Patent No.: US 7,931,385 B1
(45) Date of Patent: Apr. 26, 2011

(54) SOLAR POWERED LIGHTING FOR RAILING SYSTEMS

(76) Inventor: Elizabeth Smith, Franklin Lakes, NJ (US)

( * ) Notice: Subject to any disclaimer, the term of this patent is extended or adjusted under 35 U.S.C. 154(b) by 355 days.

(21) Appl. No.: 12/249,105

(22) Filed: Oct. 10, 2008

(51) Int. Cl.
*F21S 8/00* (2006.01)
*F21L 4/08* (2006.01)

(52) U.S. Cl. ..... 362/145; 362/183

(58) Field of Classification Search ..... 362/145, 362/146, 183, 249.02
See application file for complete search history.

(56) References Cited

U.S. PATENT DOCUMENTS

| | | | | |
|---|---|---|---|---|
| 2,310,593 | A * | 2/1943 | Orlicki | 362/146 |
| 4,379,324 | A | 4/1983 | Thompson | |
| 4,491,902 | A | 1/1985 | Cangelosi | |
| 4,823,241 | A * | 4/1989 | Trattner | 362/183 |
| D301,757 | S | 6/1989 | Hanson | |
| 4,888,669 | A | 12/1989 | Hanson | |
| 5,001,611 | A | 3/1991 | Beachy et al. | |
| 6,004,154 | A | 12/1999 | O'Brien | |
| 7,322,714 | B2 | 1/2008 | Barnett et al. | |
| 2004/0105264 | A1 | 6/2004 | Spero | |
| 2008/0080174 | A1 | 4/2008 | Xu | |
| 2008/0266856 | A1 * | 10/2008 | Chien | 362/249 |
| 2010/0008077 | A1 * | 1/2010 | Ponamar | 362/183 |

* cited by examiner

*Primary Examiner* — David V Bruce
(74) *Attorney, Agent, or Firm* — Arthur Jacob

(57) ABSTRACT

A solar powered lighting unit is affixed to a railing system to project illuminating light from the railing system. Solar powered light assemblies each have a light receptor and a light emitter placed in a linear array along a housing molded of a synthetic polymeric material. Gripping members preferably are molded unitary with the housing and are resiliently flexible so as to engage a selected member of the railing system to urge gripping surfaces against the selected member for ready attachment of the housing to the railing system. The gripping members grip the selected structural member to affix the housing to the railing system with the light receptors in position to receive impinging solar light and with the light emitters in position to emit illuminating light from the railing system.

17 Claims, 4 Drawing Sheets

SOLAR POWERED LIGHTING FOR RAILING SYSTEMS

The present invention relates generally to providing safety or decorative lighting for railing systems and pertains, more specifically, to solar powered lighting units constructed for simplified affixation to selected structural members of an outdoor railing system to increase safety and enhance aesthetic appeal.

Increasing emphasis on safety, especially in residential settings, has resulted in the installation of greater numbers of outdoor railing systems, in particular along outdoor stairways, and along decks and terraces which have become so popular in recent years. Handrails along outdoor stairways and decorative rails along decks and elevated terraces now are considered not only a matter of convenience and aesthetic design, but in so many instances are mandated by local regulations as safety measures. While it has been recognized that the provision of lighting in these settings would enhance both safety and aesthetic appeal, the fact that these railing systems are located outdoors, often placed somewhat remote from a convenient source of electric power, renders the installation of traditional electrically wired lighting systems relatively expensive, and maintenance at best inconvenient.

More recently, outdoor lighting systems have been developed around the use of solar powered lighting units. Such units have been made available for use in connection with marking walkways and providing various aesthetic effects in gardens and the like. The present invention utilizes such currently available lighting technology to provide solar powered lighting units for ready use in connection with lighting along outdoor railing systems in promoting safety as well as increased aesthetic appeal. As such, the present invention attains several objects and advantages, some of which are summarized as follows: Provides solar powered lighting units constructed for ready attachment to a selected structural member of an outdoor railing system to enhance safety; enables the creation of various decorative lighting effects along outdoor railing systems, with ease and economy; simplifies the establishment of safety or decorative lighting in connection with outdoor railing systems without requiring the expense associated with the installation and maintenance of a conventional electrical wiring system; makes use of current solar powered lighting technology for providing convenient, effective and relatively economical lighting in the vicinity of outdoor railing systems to promote greater safety, or for aesthetically desirable decorative effects; provides solar powered lighting units of simplified, relatively inexpensive construction for promoting widespread use in connection with lighting along outdoor railing systems; enables ready installation in connection with lighting at outdoor railing systems without the need for a high degree of skill or specialized tools; establishes reliable and economical lighting in connection with outdoor railing systems, with reduced requirements for maintenance and increased ease of any required maintenance; provides relatively rugged solar lighting units capable of exemplary performance in connection with lighting along outdoor railing systems over an extended service life.

The above objects and advantages, as well as further objects and advantages, are attained by the present invention, which may be described briefly as a solar powered lighting unit for affixation to a selected structural member of a railing system to project illuminating light from the selected structural member, the selected structural member having a portion of predetermined configuration and dimensions, the solar powered lighting unit comprising: a housing having an obverse light area and a reverse basal area; at least one solar powered light assembly within the housing, the solar powered light assembly including a solar light receptor along the obverse light area for receiving solar light impinging upon the housing, and a light emitter for emitting illuminating light from the housing; and a mounting arrangement for affixing the housing to the selected structural member, the mounting arrangement including a basal gripping surface extending along the reverse basal area and being dimensioned and configured for engaging a first portion of the selected structural member, and gripping members integral with the housing and having further gripping surfaces dimensioned and configured for engaging further portions of the selected structural member, the gripping members being resiliently flexible with respect to the basal gripping surface for urging resilient conformance of the further gripping surfaces generally to corresponding further portions of the selected structural member, while urging the basal gripping surface into gripping engagement with the first portion of the selected structural member such that upon engagement of respective gripping surfaces with the first portion and corresponding further portions of the selected structural member, the gripping members will grip the selected structural member to affix the housing to the railing system with the light receptor in position to receive impinging solar light and with the light emitter in position to emit illuminating light from the railing system.

In addition, the present invention includes a method for providing an outdoor railing system with illuminating light during darkness hours, the method comprising: providing at least one solar powered lighting unit for affixation to a selected structural member of the railing system, the solar powered lighting unit including a housing having an obverse light area, a reverse basal area, and at least one solar powered light assembly within the housing, the solar powered light assembly including a solar light receptor along the obverse light area for receiving solar light impinging upon the housing, and a light emitter for emitting illuminating light from the housing, a basal gripping surface extending along the reverse basal area and being dimensioned and configured for engaging a first portion of the selected structural member, and gripping members integral with the housing and having further gripping surfaces dimensioned and configured for engaging further portions of the selected structural member, the gripping members being resiliently flexible with respect to the basal gripping surface; and engaging the housing with the selected structural member to urge resilient conformance of the further gripping surfaces generally to corresponding further portions of the selected structural member, while urging the basal gripping surface into gripping engagement with the first portion of the selected structural member such that upon completing engagement of respective gripping surfaces with the first portion and corresponding further portions of the selected structural member, the gripping members will grip the selected structural member to affix the housing to the railing system with the light receptor in position to receive impinging solar light and with the light emitter in position to emit illuminating light from the railing system.

The present invention will be understood more fully, while still further objects and advantages will become apparent, the in the following detailed description of preferred embodiments of the invention illustrated in the accompanying drawing, in which.

Figure 1:
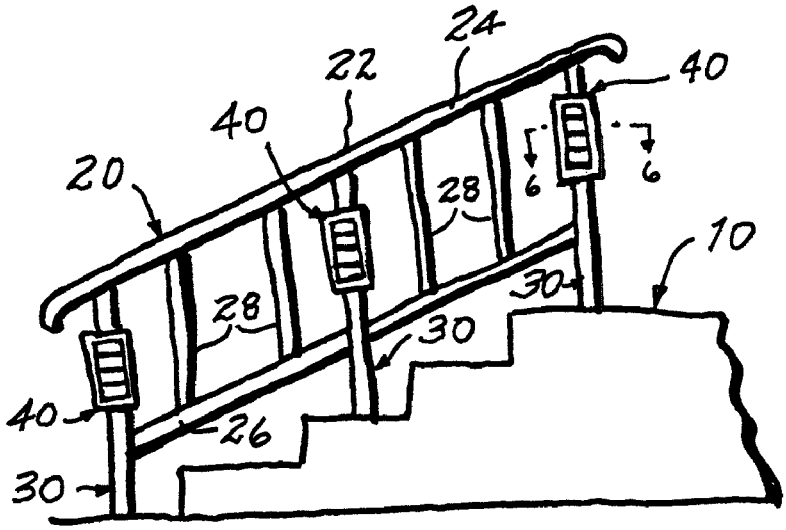
FIG. 1 is a somewhat diagrammatic, elevational pictorial view of an outdoor stairway having a safety handrail system and lighted with solar powered lighting units constructed and installed in accordance with the present invention.

Referring now to the drawing, and especially to FIG. 1 thereof, an outdoor stairway 10 is shown provided with a safety handrail system 20 which includes a handrail assembly 22 having structural members in the form of an upper handrail 24, a lower rail 26, and balusters 28 connected between the handrail 24 and the lower rail 26. Handrail assembly 22 is supported adjacent the stairway 10 by further structural members in the form of a plurality of columns 30 extending vertically at horizontally spaced intervals along the stairway 10, all of which is conventional in the construction of outdoor stairways and accompanying handrail systems.

In order to enhance safety during hours of darkness, a plurality of solar powered lighting units constructed in accordance with the present invention, shown at 40, are affixed to handrail system 20, with one unit 40 attached to each column 30. Each solar powered lighting unit 40 is located and oriented on a respective column 30 so as to receive sunlight during daytime hours and then emit light in the direction of stairway 10 to light the stairway 10 during darkness hours.

Turning now to FIGS. 2 through 6, solar powered lighting unit 40 includes a housing 50 having an obverse light area 52 extending along the front 54 of housing 50, and a reverse basal area 56 extending along the rear 58 of the housing 50. At least one solar powered light assembly 60 is secured within the housing 50, in place along the light area 52, and preferably a plurality of light assemblies 60, illustrated as four light assemblies 60, are secured within the housing 50, in place in a linear array along the light area 52, the linear array extending longitudinally along the length of the light area 52, as illustrated in the embodiment of FIGS. 2 through 6. Each light assembly 60 includes a light receptor 62 exposed along the light area 52 for receiving solar light impinging upon the housing 50 during daylight hours, and a light emitter 64 for emitting illuminating light during darkness hours, as is conventional in solar powered light units. The illuminating light is directed toward the stairway 10 for providing a high degree of safety during nighttime use of the stairway 10.

Figure 5:
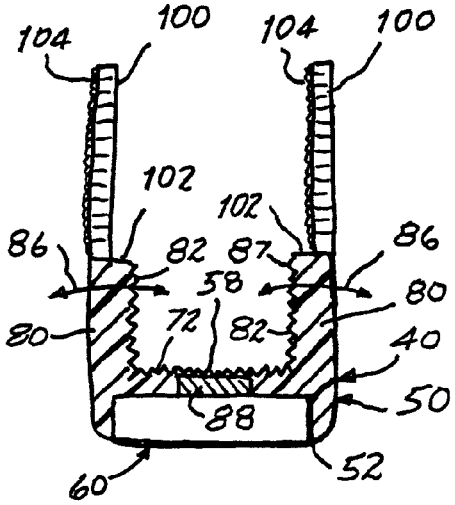
FIG. 5 is a cross-sectional view taken along line 5-5 of FIG. 3.
Figure 6:
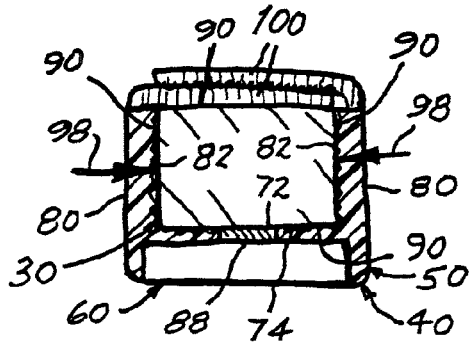
FIG. 6 is an enlarged cross-sectional view taken along line 6-6 of FIG. 1.

Housing 50 preferably is constructed of a synthetic polymeric material selected for weather resistance, as well as for maintaining an aesthetically pleasing appearance and providing resistance to impacts which may be experienced during the service life of lighting unit 40. A mounting arrangement 70 for affixing the housing 50 to a column 30 includes a basal gripping surface 72 extending along the reverse basal area 56, the basal gripping surface 72 being dimensioned and configured for engaging the column 30 along a first portion 74 of the column 30, as illustrated in FIG. 6. Mounting arrangement 70 further includes gripping members 80 integral with, and preferably molded unitary with, the housing 50, the gripping members 80 having further gripping surfaces 82 dimensioned and configured for engaging further portions 84 of the column 30, as depicted in FIG. 6. In the illustrated embodiment, column 30 has a generally rectangular cross-sectional configuration and the gripping surfaces 72 and 82 follow a generally rectangular pattern which enables the gripping surfaces 72 and 82 to conform closely to the column 30 for enhancement of the grip of housing 50 on column 30. To that end, gripping members 80 project outwardly from basal gripping surface 72 and are resiliently flexible in transverse directions, as indicated in FIG. 5 by arrows 86, such that upon housing 50 being engaged with column 30, as seen in FIG. 6, gripping surfaces 82 will extend generally normal to basal gripping surface 72 and will be resiliently biased against column 30 to establish a firm grip sufficient to affix housing 50 to column 30. Preferably, the firm grip is enhanced by providing gripping surfaces 72 and 82 with a gripping configuration, shown in the form of serrations 87 which are molded into and extend in longitudinal directions along the gripping surfaces 72 and 82. The preferred synthetic polymeric material for housing 50 is a polypropylene which exhibits physical characteristics for establishing requisite gripping forces, while providing the housing 50 with a rugged and aesthetically pleasing construction for a long and effective service life. Selectively removable panels 88 are accessed from the reverse basal area 56 for selective removal to gain access to each unit 40 for replacing batteries, should replacement become necessary, thereby simplifying maintenance.

Figure 2:
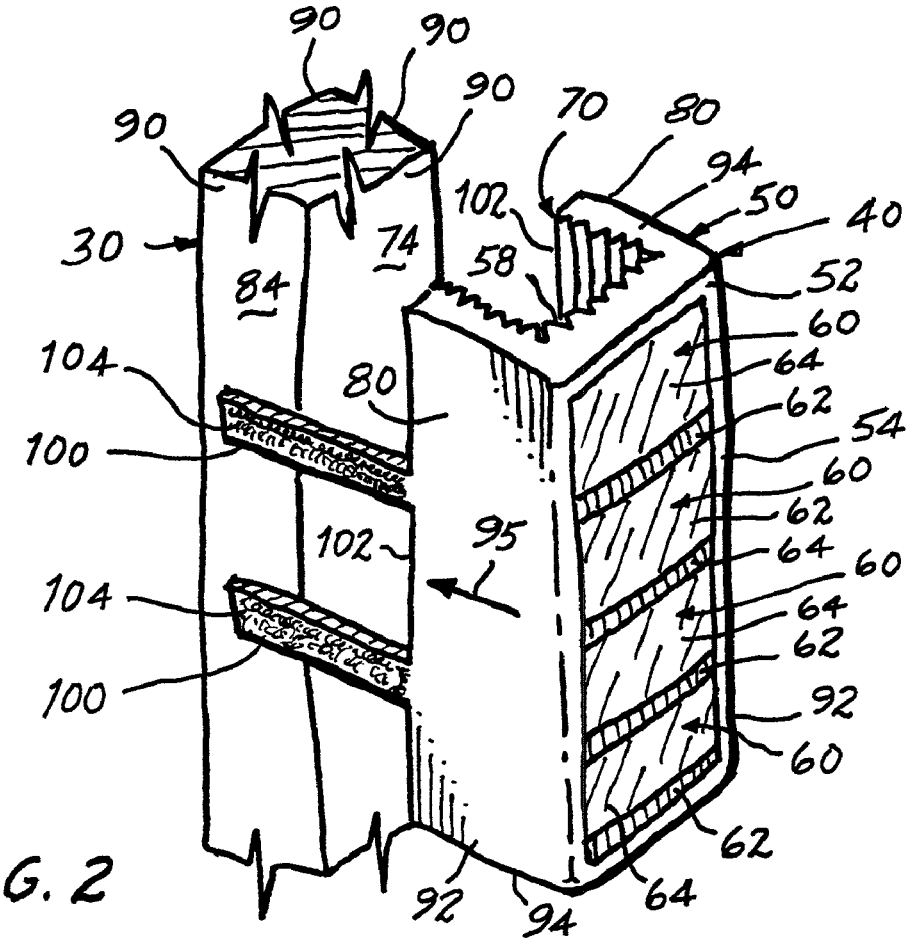
FIG. 2 is an enlarged front, side and end exploded, partly fragmentary pictorial view showing one of the solar powered lighting units illustrated in FIG. 1 and a fragment of a selected structural member of the handrail system to which the solar powered lighting unit is attached.
Figure 3:
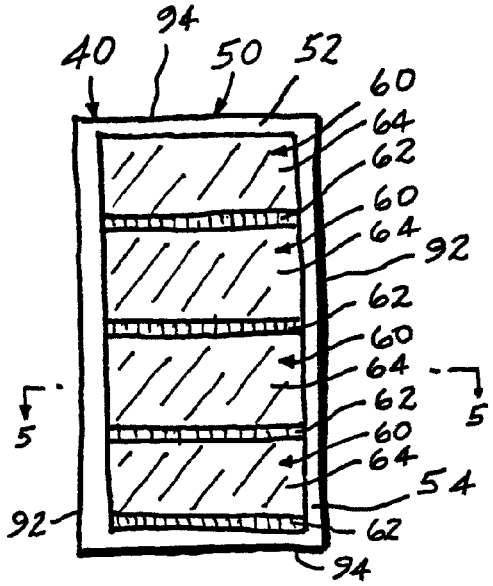
FIG. 3 is a front elevational view of the solar powered lighting unit.
Figure 4:
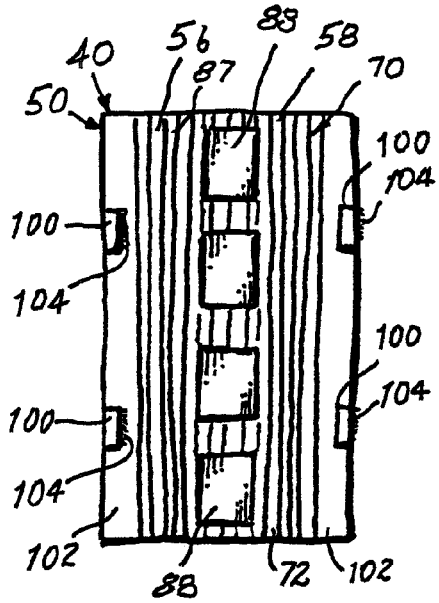
FIG. 4 is a rear elevational view of the solar powered lighting unit.

In the illustrated handrail system 20, column 30 has a generally rectangular cross-sectional configuration, as seen in FIGS. 2 and 6, with the column 30 having four perimetric sides 90 bounding the rectangular cross-sectional configuration. In the preferred embodiment illustrated in the form of solar powered lighting unit 40, housing 50 has a parallelepiped configuration with opposite sides 92 spaced apart laterally and extending between longitudinally spaced apart ends 94. Basal gripping surface 72 is generally rectangular, and gripping members 80 project from gripping surface 72 in an altitudinal direction 95, along opposite sides 92, and preferably normal to the basal gripping surface 72, the gripping members 80 being resiliently flexible with respect to basal gripping surface 72 for movement in the lateral directions 86 toward and away from one another, while the resilient nature of the material of housing 50 establishes resilient biasing forces 98 for gripping the column 30 to secure the housing 50 on the column 30, as seen in FIG. 6. Installation of the solar powered lighting unit 40 on column 30 then is quite simple, merely requiring the housing 50 to be grasped and manually moved in the altitudinal direction 95 onto the selected column 30 such that the gripping members 80 straddle column 30 and gripping surfaces 72 and 82 engage three corresponding adjacent ones of the four perimetric sides 90 of the column 30, with the gripping members 80 urged apart laterally to establish inwardly directed biasing forces 98 sufficient to maintain the gripping surfaces 72 and 82 in gripping engagement with the corresponding perimetric sides 90 of the column 30 and affix the housing 50 to the column 30. Selective removal of lighting unit 40 from column 30 is accomplished merely by reversing the above procedure to withdraw the lighting unit 40 from the column 30. In this manner, lighting units 40 are available for simple selective relocation and rearrangement, as desired, or for replacement, if necessary. In addition, access panels 88 are reached readily for routine maintenance.

While the above-described mounting arrangement enables simplified installation of lighting units 40 and provides sufficient gripping strength when the units 40 are mounted upon columns 30 of standard nominal dimensions, some variations in dimensions from column to column which may go beyond those nominal dimensions that can be safely accommodated by the range of resilient flexibility provided by gripping members 80 may require a supplemental mounting feature. Accordingly, each housing 50 is provided with integral straps 100 projecting rearwardly from rearward edges 102 of gripping members 80 and carrying fastener elements, shown in the form of complementary hook-and-loop fastener elements 104, enabling pairs of corresponding straps 100 to be wrapped around a column 30 and overlap the fourth one of perimetric sides 90 to further secure the housing 50 to the column 30, as depicted in FIG. 6.

Figure 7:
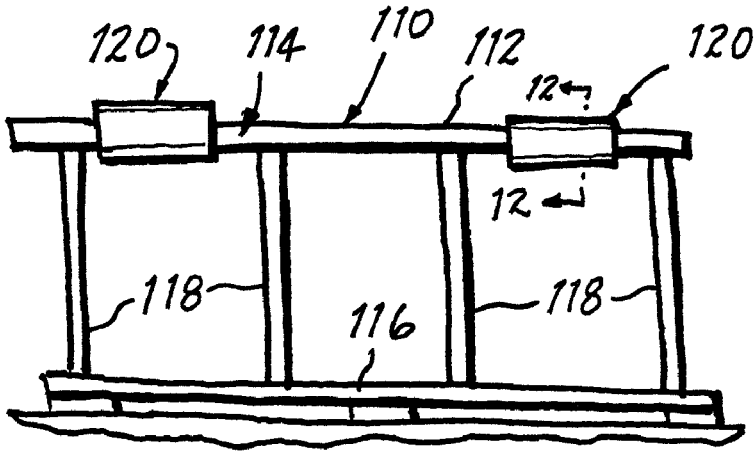
FIG. 7 is a somewhat diagrammatic, elevational pictorial view of an outdoor deck railing system lighted with solar powered lighting units constructed in accordance with the present invention.

Referring now to FIGS. 7 through 12, another embodiment of the present invention is illustrated in connection with providing lighting along a deck railing system 110 which, as seen in FIG. 7, includes a deck railing assembly 112 having structural members in the form of an upper rail 114, a lower rail 116, and balusters 118 connected between the upper rail 114 and the lower rail 116, all of which is conventional in the construction of deck railing systems.

In order to provide a decorative effect, as well as to enhance safety, during hours of darkness, a plurality of solar powered lighting units constructed in accordance with the present invention, shown at 120, are affixed to deck railing system 110, with units 120 attached to upper rail 114 at longitudinally spaced apart locations along the upper rail 114. Each solar powered lighting unit 120 is located and oriented on the upper rail 114 so as to receive sunlight during daytime hours and then emit light in directions which will enhance safety and aesthetic appearance during darkness hours.

Turning now to FIGS. 8 through 12, solar powered lighting unit 120 includes a housing 150 having an obverse light area 152 extending along the top 154 of housing 150, and a reverse basal area 156 extending along the bottom 158 of the housing 150. At least one solar powered light assembly 160 is secured within the housing 150, located within the light area 152, and preferably a plurality of light assemblies 160, illustrated as three light assemblies 160 in a linear array, are placed within the housing 150, along the light area 152, arrayed longitudinally along the length of the light area 152, as illustrated in the embodiment of FIGS. 7 through 12. Each light assembly 160 includes a light receptor 162 exposed along the light area 152 for receiving solar light impinging upon the housing 150 during daylight hours, and a light emitter 164 for emitting illuminating light during darkness hours, as is conventional in solar powered light units. The illuminating light is directed upwardly for providing an aesthetically pleasing decorative effect as well as enhanced safety during nighttime hours.

Figure 12:
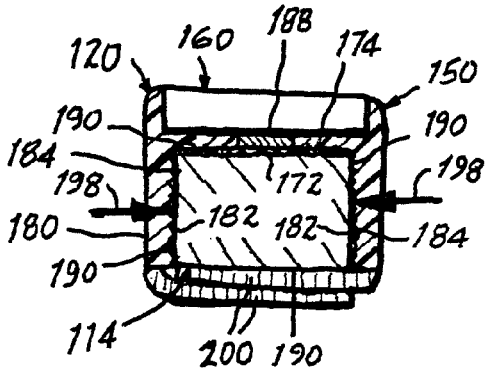
FIG. 12 is an enlarged cross-sectional view taken along line 12-12 of FIG. 7.

Housing 150 preferably is constructed of a synthetic polymeric material selected for weather resistance, as well as for maintaining an aesthetically pleasing appearance and providing resistance to impacts which may be experienced during the service life of lighting unit 120. A mounting arrangement 170 for affixing the housing 150 to the upper rail 114 includes a basal gripping surface 172 extending along the reverse basal area 156, the basal gripping surface 172 being dimensioned and configured for engaging the upper rail 114 along a first portion 174 of the upper rail 114, as illustrated in FIG. 12. Mounting arrangement 170 further includes gripping members 180 integral with, and preferably molded unitary with, the housing 150, the gripping members 180 having further gripping surfaces 182 dimensioned and configured for engaging further portions 184 of the upper rail 114, as depicted in FIG. 12. In the illustrated embodiment, upper rail 114 has a generally rectangular cross-sectional configuration and the gripping surfaces 172 and 182 follow a generally rectangular pattern which enables the gripping surfaces 172 and 182 to conform closely to the upper rail 114 for enhancement of the grip of housing 150 on upper rail 114. To that end, gripping members 180 project outwardly in a downward direction from basal gripping surface 172 and are resiliently flexible such that upon housing 150 being engaged with upper rail 114, as seen in FIG. 12, gripping surfaces 182 will extend generally normal to basal gripping surface 172 and will be resiliently biased against upper rail 114 to establish a firm grip sufficient to affix housing 150 to upper rail 114. Preferably, the firm grip is enhanced by providing gripping surfaces 172 and 182 with a gripping configuration, shown in the form of serrations 187 which are molded into and extend in longitudinal directions along the gripping surfaces 172 and 182. The preferred synthetic polymeric material for housing 150 is polypropylene which exhibits physical characteristics for establishing requisite gripping forces, while providing the housing 150 with a rugged and aesthetically pleasing construction for a long and effective service life. Selectively removable panels 188 are accessed from the reverse basal area 156 for selective removal to gain access to each unit 120 for replacing batteries, should replacement become necessary.

Figure 8:
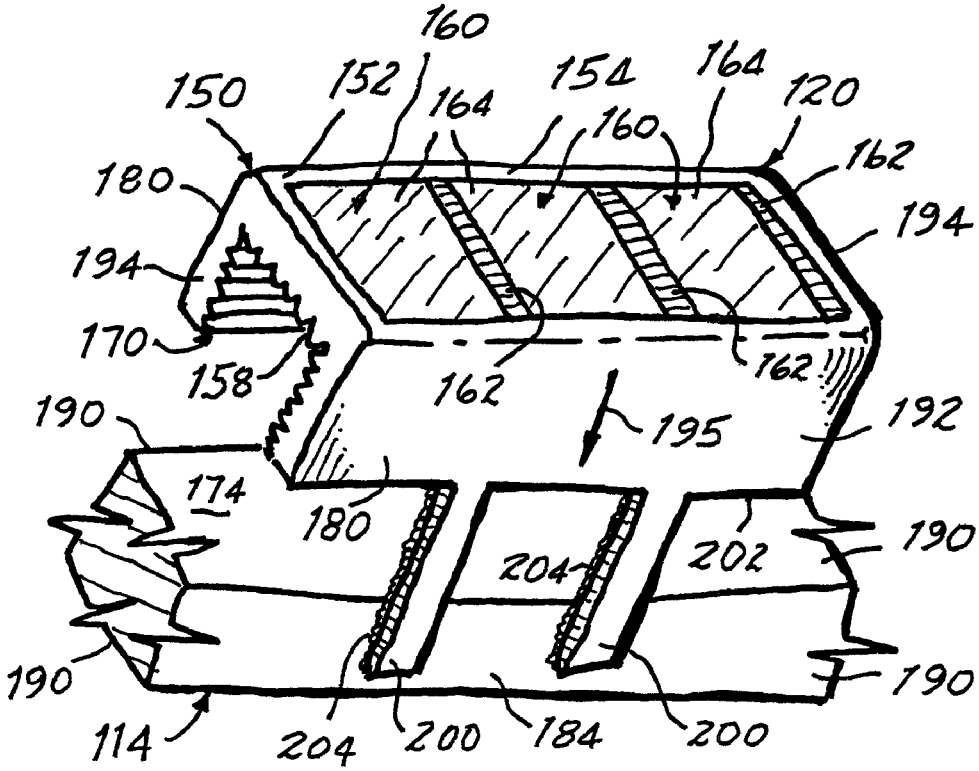
FIG. 8 is an enlarged top, side and end exploded, partly fragmentary pictorial view showing one of the solar powered lighting units illustrated in FIG. 7 and a fragment of a selected structural member of the deck railing system to which the solar powered lighting unit is attached.
Figure 9:
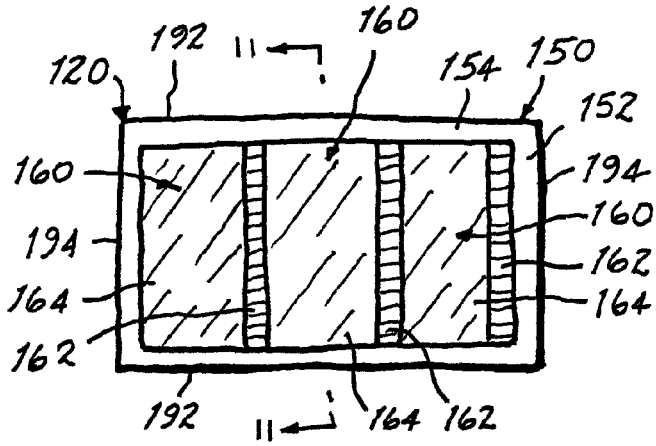
FIG. 9 is a top plan view of the solar powered lighting unit of FIG. 8.
Figure 10:
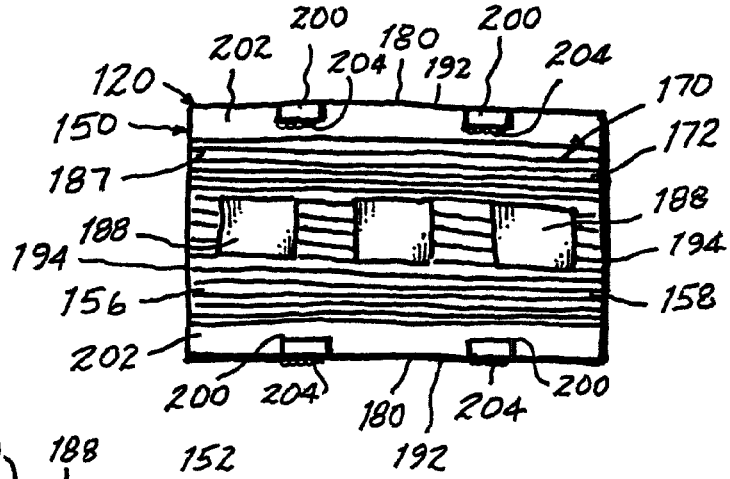
FIG. 10 is a bottom plan view of the solar powered lighting unit of FIG. 8.
Figure 11:
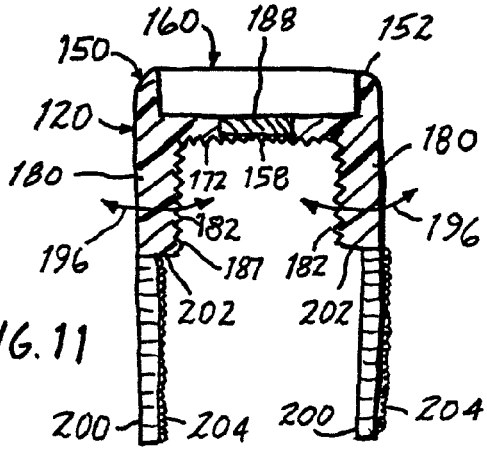
FIG. 11 is a cross-sectional view taken along line 11-11 of FIG. 9.

In the illustrated deck railing system 110, upper rail 114 has a generally rectangular cross-sectional configuration, as seen in FIGS. 8 and 12, with the upper rail 114 having four perimetric sides 190 bounding the rectangular cross-sectional configuration. In the preferred embodiment illustrated in the form of solar powered lighting unit 120, housing 150 has a parallelepiped configuration with opposite sides 192 spaced apart laterally and extending between longitudinally spaced apart ends 194. Basal gripping surface 172 is generally rectangular, and gripping members 180 project from basal gripping surface 172 along opposite sides 192, in an altitudinal direction 195, and preferably normal to the basal gripping surface 172, the gripping members 180 being resiliently flexible with respect to basal gripping surface 172 for movement in directions toward and away from one another, as illustrated in FIG. 11 by arrows 196, while the resilient nature of the material of housing 150 establishes resilient biasing forces 198 for gripping the upper rail 114 to secure the housing 150 on the upper rail 114, as seen in FIG. 12. Installation of the solar powered lighting unit 120 on upper rail 114 then is quite simple, merely requiring the housing 150 to be grasped and manually moved in the altitudinal direction 195 onto the upper rail 114 such that the gripping members 180 straddle upper rail 114 and gripping surfaces 172 and 182 engage three corresponding adjacent ones of the four perimetric sides 190 of the upper rail 114, with the gripping members 180 urged apart laterally to establish inwardly directed biasing forces 198 sufficient to maintain the gripping surfaces 172 and 182 in gripping engagement with the corresponding perimetric sides 190 of the upper rail 114 and affix the housing 150 to the upper rail 114. Selective removal of lighting unit 120 from upper rail 114 is accomplished merely by reversing the above procedure to withdraw the lighting unit 120 from the upper rail 114. In this manner, lighting units 120 are available for simple selective relocation and rearrangement, as desired, or for replacement, if necessary. In addition, access panels 188 are reached readily for routine maintenance.

While the above-described mounting arrangement enables simplified installation of lighting units 120 and provides sufficient gripping strength when the units 120 are mounted upon an upper rail 114 of standard nominal dimensions, some variations in dimensions from upper rail to upper rail which may go beyond those nominal dimensions that can be safely accommodated by the range of resilient flexibility provided by gripping members 180 may require a supplemental mounting feature. Accordingly, each housing 150 is provided with integral straps 200 projecting outwardly and downwardly from lower edges 202 of gripping members 180, as seen in FIG. 11, and carrying fastener elements, shown in the form of complementary hook-and-loop fastener elements 204, enabling mating pairs of straps 200 to be wrapped around upper rail 114 and overlap the fourth one of perimetric sides 190 to further secure the housing 150 to the upper rail 114, as depicted in FIG. 12.

It will be seen that the present invention attains all of the objects and advantages summarized above, namely: Provides solar powered lighting units constructed for ready attachment to a selected structural member of an outdoor railing system to enhance safety; enables the creation of various decorative lighting effects along outdoor railing systems, with ease and economy; simplifies the establishment of safety or decorative lighting in connection with outdoor railing systems without requiring the expense associated with the installation and maintenance of a conventional electrical wiring system; makes use of current solar powered lighting technology for providing convenient, effective and relatively economical lighting in the vicinity of outdoor railing systems to promote greater safety, or for aesthetically desirable decorative effects; provides solar powered lighting units of simplified, relatively inexpensive construction for promoting widespread use in connection with lighting along outdoor railing systems; enables ready installation in connection with lighting at outdoor railing systems without the need for a high degree of skill or specialized tools; establishes reliable and economical lighting in connection with outdoor railing systems, with reduced requirements for maintenance and increased ease of any required maintenance; provides relatively rugged solar lighting units capable of exemplary performance in connection with lighting along outdoor railing systems over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A solar powered lighting unit for affixation to a selected structural member of a railing system to project illuminating light from the selected structural member, the selected structural member having a portion of predetermined configuration and dimensions, the solar powered lighting unit comprising:

a housing having an obverse light area and a reverse basal area;

at least one solar powered light assembly within the housing, the solar powered light assembly including a solar light receptor along the obverse light area for receiving solar light impinging upon the housing, and a light emitter for emitting illuminating light from the housing; and a mounting arrangement for affixing the housing to the selected structural member, the mounting arrangement including a basal gripping surface extending along the reverse basal area and being dimensioned and configured for engaging a first portion of the selected structural member, and gripping members integral with the housing and having further gripping surfaces dimensioned and configured for engaging further portions of the selected structural member, the gripping members being resiliently flexible with respect to the basal gripping surface for urging resilient conformance of the further gripping surfaces generally to corresponding further portions of the selected structural member, while urging the basal gripping surface into gripping engagement with the first portion of the selected structural member such that upon engagement of respective gripping surfaces with the first portion and corresponding further portions of the selected structural member, the gripping members will grip the selected structural member to affix the housing to the railing system with the light receptor in position to receive impinging solar light and with the light emitter in position to emit illuminating light from the railing system.

2. The solar powered lighting unit of claim 1 wherein the selected structural member has a generally rectangular cross-sectional configuration and four perimetric faces, the basal gripping surface has a generally rectangular configuration extending longitudinally along the housing and laterally across the housing, and the gripping members extend from the basal gripping surface in a generally altitudinal direction such that upon mounting of the housing on the selected structural member, the basal gripping surface and the further gripping surfaces will extend along three adjacent ones of the four perimetric faces.

3. The solar powered lighting unit of claim 2 including supplemental securing members extending from the gripping members for being wrapped over a fourth one of the four perimetric faces and attached to one another to further secure the housing to the selected structural member.

4. The solar lighting unit of claim 2 wherein the gripping members extend from the basal gripping surface in a direction generally normal to the basal gripping surface.

5. The solar lighting unit of claim 4 including supplemental securing members extending from the gripping members for being wrapped over a fourth one of the four perimetric sides and attached to one another to further secure the housing to the selected structural member.

6. The solar lighting unit of claim 5 wherein the supplemental securing members comprise flexible straps integral with the gripping members.

7. The solar lighting unit of claim 2 including a gripping configuration extending along each of the further gripping surfaces.

8. The solar lighting unit of claim 7 including a further gripping configuration extending along the basal gripping surface.

9. The solar lighting unit of claim 8 wherein the gripping configuration and the further gripping configuration comprise serrations extending longitudinally along the basal gripping surface and longitudinally along the further gripping surfaces.

10. The solar lighting unit of claim 2 wherein the housing has a generally parallelepiped configuration including laterally opposite sides extending between longitudinally opposite ends, the gripping members extend longitudinally between the opposite ends, and the gripping members are resiliently flexible in lateral directions toward and away from one another.

11. The solar lighting unit of claim 10 wherein the housing is molded of a synthetic polymeric material, the gripping members being unitary with the laterally opposite sides of the parallelepiped configuration.

12. The solar lighting unit of claim 1 including a plurality of solar powered light assemblies placed in a linear array along the obverse light area.

13. The solar lighting unit of claim 12 wherein the selected structural member has a generally rectangular cross-sectional configuration and four perimetric faces, the basal gripping surface has a generally rectangular configuration extending longitudinally along the housing and laterally across the housing, and the gripping members extend from the basal gripping surface in a generally altitudinal direction such that upon mounting of the housing on the selected structural member, the basal gripping surface and the further gripping surfaces will extend along three adjacent ones of the four perimetric faces.

14. The solar lighting unit of claim 13 wherein the housing has a generally parallelepiped configuration including laterally opposite sides extending between longitudinally opposite ends, the gripping members extend longitudinally between the opposite ends, and the gripping members are resiliently flexible in lateral directions toward and away from one another.

15. The solar lighting unit of claim 14 wherein the housing is molded of a synthetic polymeric material, the gripping members being unitary with the laterally opposite sides of the parallelepiped configuration.

16. A method for providing an outdoor railing system with illuminating light during darkness hours, the method comprising:

providing at least one solar powered lighting unit for affixation to a selected structural member of the railing system, the solar powered lighting unit including a housing having an obverse light area, a reverse basal area, and at least one solar powered light assembly within the housing, the solar powered light assembly including a solar light receptor along the obverse light area for receiving solar light impinging upon the housing, and a light emitter for emitting illuminating light from the housing, a basal gripping surface extending along the reverse basal area and being dimensioned and configured for engaging a first portion of the selected structural member, and gripping members integral with the housing and having further gripping surfaces dimensioned and configured for engaging further portions of the selected structural member, the gripping members being resiliently flexible with respect to the basal gripping surface; and engaging the housing with the selected structural member to urge resilient conformance of the further gripping surfaces generally to corresponding further portions of the selected structural member, while urging the basal gripping surface into gripping engagement with the first portion of the selected structural member such that upon completing engagement of respective gripping surfaces with the first portion and corresponding further portions of the selected structural member, the gripping members will grip the selected structural member to affix the housing to the railing system with the light receptor in position to receive impinging solar light and with the light emitter in position to emit illuminating light from the railing system.

17. The method of claim 16 wherein the selected structural member has a generally rectangular cross-sectional configuration bounded by four perimetric faces, the basal gripping surface has a generally rectangular configuration extending longitudinally along the housing and laterally across the housing, and the gripping members extend from the basal gripping surface in a generally altitudinal direction such that upon engaging the housing with the selected structural member, the housing is moved in the altitudinal direction, and the basal gripping surface and the further gripping surfaces are extended along three adjacent ones of the four perimetric faces.

* * * * *